United States Patent [19]

Simashkevich et al.

[11] Patent Number: 4,544,100

[45] Date of Patent: Oct. 1, 1985

[54] LIQUID SPRAY GUN HAVING QUICK CHANGE PATTERN CONTROL

[75] Inventors: Richard M. Simashkevich, Lorain; William J. Sharp, Wakeman, both of Ohio

[73] Assignee: Nordson Corporation, Amherst, Ohio

[21] Appl. No.: 539,658

[22] Filed: Oct. 6, 1983

[51] Int. Cl.[4] ..... B05B 7/12

[52] U.S. Cl. ..... 239/407; 239/300; 239/415; 239/424

[58] Field of Search ..... 239/407, 424, 300, 291, 239/414, 415, 416.1, 416.2, 527, 528

[56] References Cited

U.S. PATENT DOCUMENTS

| | | | |
|---|---|---|---|
| 2,470,718 | 5/1949 | Peeps | 239/300 |
| 2,518,759 | 8/1950 | Dalrymple | 229/140.1 |
| 2,626,122 | 1/1953 | Lammiman | 251/2 |
| 2,708,095 | 5/1955 | Mitchell | 251/229 |
| 2,864,649 | 12/1958 | Adams | 299/140.1 |
| 3,687,368 | 9/1972 | Gerberth, Jr. | 239/15 |
| 4,381,081 | 4/1983 | Hastings | 239/424 |
| 4,426,039 | 1/1984 | Kwok | 239/415 |

*Primary Examiner*—James B. Marbert

*Attorney, Agent, or Firm*—Wood, Herron & Evans

[57] ABSTRACT

A liquid dispensing gun wherein a spray pattern control valve is located internally of the gun. The spray pattern control valve is in the form of a two position air flow valve movable between a first position wherein low air flow is supplied through the valve to a second position wherein high air flow is provided through the valve. The valve has two adjustable stops operable to fix the low air flow and the high air flow positions of the valve. Manual pressure on the stem of the valve controls movement between the two positions.

17 Claims, 4 Drawing Figures

LIQUID SPRAY GUN HAVING QUICK CHANGE PATTERN CONTROL

This invention relates to spray guns and more particularly to air valves for controlling the spray pattern dispensed from a spray gun.

Spray guns conventionally utilize compressed air for atomizing the liquid spray material dispensed from such guns and for impacting opposite sides of the atomized air stream issuing from the gun so as to flatten the atomized liquid stream into a fan shape.

In order to secure spray patterns of various widths adaptable for effectively coating surfaces of different areas, it is customary to have an adjustable valve in the passage delivering air to the fan pattern jets. The flattening force of the air jets is reduced or increased by closing or opening of the fan pattern control valve.

Conventionally, the fan pattern control valve has a tapered inner end which seats within the air passage, a threaded shank by which it is rotatably mounted, and an external knurled head for manual adjustment. It is thus possible to set the valve for a particular flow of air that will shape the spray pattern most suitably for a certain application. Such a spray gun and valve construction is illustrated and described in Harjar, et al U.S. Pat. No. 4,126,321, assigned to the assignee of this application.

In some spray coating operations, the character of the products being coated is such that a single width of spray is satisfactory for all purposes. However, in other finishing applications, there are surfaces of restricted area for which a wide spray pattern is not suitable. Under such circumstances it is necessary for the operator to screw the spray control valve part way toward a closed position so as to change the pattern. He must subsequently then upon completion of the spraying of the restricted area screw the spray width back to its original setting. In the process of making these adjustments, production time is lost.

In U.S. Pat. No. 2,626,122 and U.S. Pat. No. 2,708,095 there are disclosed adjustable fan pattern control valves for varying the air flow delivered to the fan pattern jets of a spray gun. The valves disclosed in these patents are adjustable in the same way as is described hereinabove, but additionally, these valves are manually movable against a spring bias to a fully closed position wherein the fan pattern flattening air jets are completely shut off from the air supply so as to quickly change from an adjusted width fan pattern to a very narrow spray pattern. Upon release of the force acting against the spring pressure, the valves of these patterns return to the originally adjusted position.

The disadvantage of the quick change pattern control valves disclosed in the two above identified patents is that they permit the valve to only go between an adjusted position and a fully off position. They do not permit the valve to go between a low adjustable air flow setting and a high adjustable air flow setting so as to spray two different adjustable spray patterns. It has therefore been a primary objective of this invention to provide an improved quick change pattern control valve for a spray gun which is effective to quickly enable a change to be made from one adjustably narrow width spray pattern to a different adjustable width spray pattern.

Still another objective of this invention has been to provide an improved quick change pattern control valve for a spray gun which is manually movable by axial pressure on the end of an adjustment knob of a fan pattern control valve assembly to move the valve between an adjustable wide spray pattern and an adjustable narrow spray pattern.

These objectives are achieved and this invention is predicated in part upon having two adjustable stops for setting both a wide pattern and a narrow pattern spray position of a quick change pattern control valve assembly. Heretofore, quick change pattern control valves have had only a single adjustable stop position rather than two adjustable stops. The quick change pattern control valve assembly of this invention comprises an air flow control valve having a valve shank or stem which passes through a hollow casing. This casing is adjustably threaded into the spray gun body. There are two stops in the form of shoulders in the adjustable casing. One of these shoulders is engageable with the shank of the valve to establish a first stop position of the valve, and the other shoulder is engageable with a nut threaded over the shank of the valve to establish the second stop position. As a result of this construction both stops may be independently adjusted relative to one another and relative to the valve located at the end of the valve shank. The valve shank and attached valve are moved between the two pattern positions by application of manual pressure on the end of the valve shank. Pushing of the valve shank forwardly moves it to a narrow fan pattern setting and pulling it rearwardly to a wide pattern setting. Rotation of the knob fixedly attached to the rearward end of the shank adjusts the width of the wide pattern setting and rotation of a nut threaded onto the shank adjusts the narrow pattern setting.

The primary advantage of this invention is that it enables a spray gun to be quickly changed from one adjustable narrow fan spray pattern to a different adjustable wide fan spray pattern, or vice versa with a minimum of lost spraying time to effect the change between the two patterns.

These and other objects and advantages of this invention will be more readily apparent from the following description of the drawings, in which.

Figure 1:
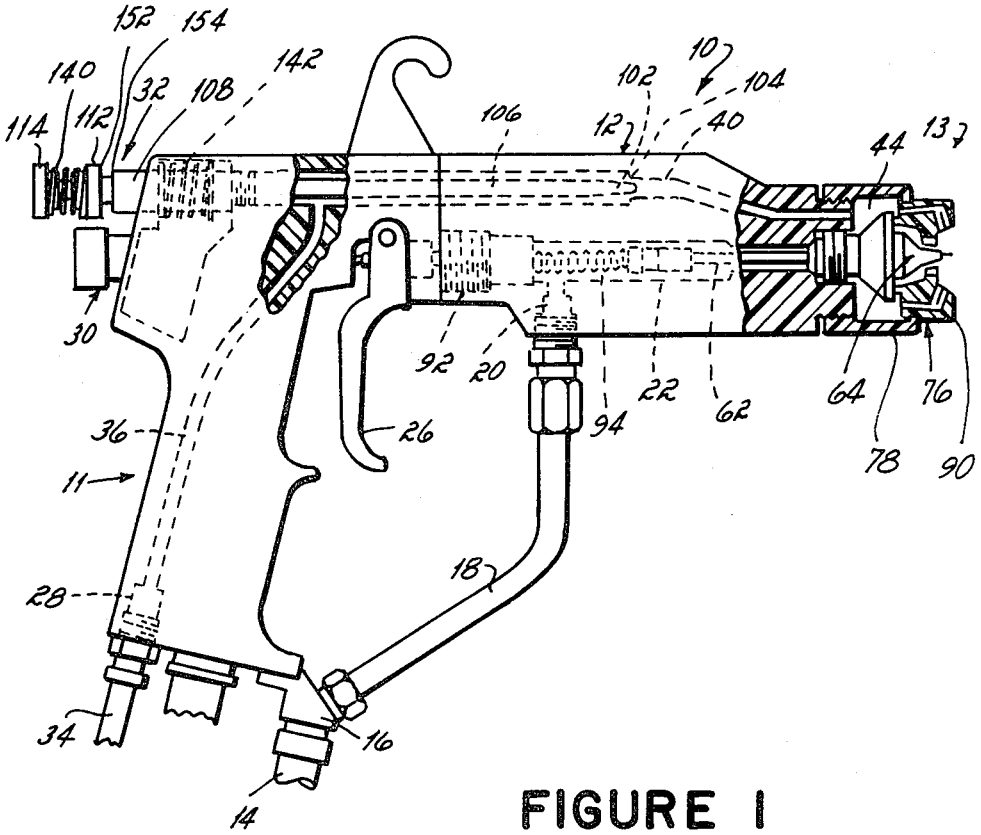
FIG. 1 is a side view, partially broken away, of a spray gun incorporating the invention of this application.

The gun illustrated in FIG. 1 of the drawings is an air operated electrostatic spray gun which relies upon the impact of an air stream with a liquid stream to effect atomization of the liquid stream.

The gun 10 comprises a handle assembly 11, an electrically insulative barrel assembly 12, and an electrically insulative nozzle assembly 13 at the forward end of the barrel 12. Paint or other spray coating material which may be in the nature of a coating, varnish or lacquer (referred to in regard to this invention generically as paint) is supplied to the gun under pressure from an external reservoir or tank (not shown) through a hydraulic hose 14.

Figure 2:
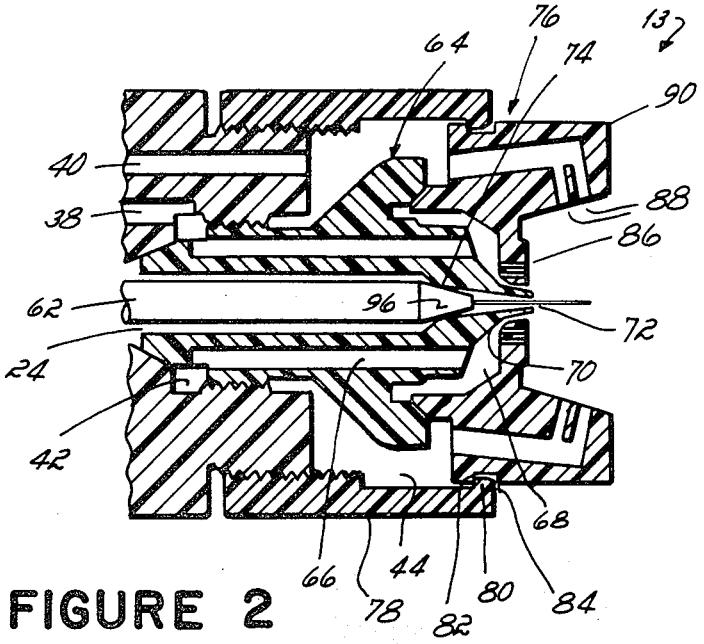
FIG. 2 is an enlarged cross-sectional view of the nozzle portion of the spray gun of FIG. 1.

The hose 14 is connected to an electrically conductive lug 16 attached to the butt end of the handle 11 and having a fluid passage through it so as to connect a fluid passage in the hose 14 to a fluid passage in a hose 18 connected between the lug 16 and an inlet passage 20 in the side of the barrel 12. The inlet passage 20 through the side of the barrel 12 communicates with an annular axial fluid flow passageway 22 in the barrel 12. The passageway 22 in turn communicates at its forward end with a central annular axial passage 24 in the nozzle assembly 13 (FIG. 2). The passages 22 and 24 are substantially axially aligned. A trigger 26 operates a needle and seat valve assembly in the passage 24 for controlling the flow of liquid out of the nozzle 13.

The handle assembly 11 includes an air inlet 28, a trigger actuated internal air flow control valve 30, the trigger 26 controlling the flow of air through the valve 30. As explained more fully hereinafter, there is also a fan pattern control valve assembly 32 in the gun for controlling the shape or "fan" of the spray emitted from the gun.

An air hose 34 is connected to the butt end of the handle 11 by suitable couplings and communicates through the air inlet 28 with a generally vertical air passage 36 in handle 11. The air passage 36 continues in a plane other than that shown in FIG. 1 through the air flow control valves 30 and 32 and eventually communicates with a pair of internal passages 38 and 40 passing through the barrel of the gun and terminating at the forward end of the barrel in communication with air chambers 42 and 44, respectively, in the nozzle 13 (FIG. 2). Passage 38 provides the atomizing air to the nozzle 13 while passage 40 provides the fan shaping air to the nozzle. The flow of air through the passages 38 and 40 is controlled by the trigger operated air flow control valve 30 while the flow of fan shaping air through the passage 40 is further controlled by the fan pattern control valve assembly 32.

The nozzle assembly is made of an electrically nonconductive material. The nozzle 13 has a fluid tip 64 which is threaded at its rear into a counterbore in the forward end of the barrel 12. The fluid tip 64 has a number of circumferentially spaced axial passages 66 which open at their rear into the counterbore to communicate with the air passage 42 such that atomizing air passing through the passage 38 into the passage 42 may enter and pass through the axial passages 66 in the fluid tip and into an internal chamber 68 surrounding the forward end of the fluid tip. The fluid tip also includes the central axial passage 24 communicating with the material flow passageway 22 in the barrel portion of the gun for supply of paint via the hoses 14 and 18 (FIG. 1) from the tank or reservoir.

The forward end of the fluid tip 64 terminates in a nozzle 70 having a small diameter orifice 72 through which the coating material is emitted. The fluid tip further includes a cone seat 74 formed inside the nozzle 70 close to the discharge orifice 72.

An air cap 76 surrounds the forward end of the fluid tip 64. The air cap is mounted to the gun by means of an annular retaining ring 78 which is threaded over a threaded section of the barrel 12 at one end and at its other end there is an annular lip 80. The retaining ring 78, although rigid, is sufficiently flexible at the lip 80 to permit the air cap to be snapped into position with the lip 80 engaging a wall 82 in an annular groove 84 in the outside surface of the air cap such that the air cap is securely retained and sealed against the escape of air to the atmosphere.

Flow of atomizing air is through the opening 86 close to the nozzle 70 and flow of the fan shaping air is through openings 88 in the opposed air horns 90.

The flow of paint through the axial flow passageways 22 and 24 is controlled by the control rod 62. The control rod 62 is mounted at its rear in a packing nut 92 and includes a flexible bellows seal 94 such that the control rod 62 is axially slidable in a forward and rearward direction upon operation of the trigger 26.

The control rod 62 terminates at its forward end in a cone shaped tip 96. The cone shaped tip cooperates with the internal seat 74 and the fluid nozzle 70 to form a needle and seat valve assembly actuatable by the trigger 26. That is, when the trigger 26 is pulled rearwardly, the rod 62 is retracted which retracts the cone shaped tip 96 of the rod from the valve seat 74 immediately behind the material discharge orifice 72, allowing the paint in the passageway 24 to flow around the tip 96 and out of the discharge orifice 72. When the trigger is released, a spring 98 moves the control rod 62 forwardly with the tip engaging the valve seat to thereby stop the flow of paint.

The spray gun heretofore described, except for the valve assembly 32, is conventional and per se forms no part of the invention of this application. The invention of this application resides rather in the novel fan pattern control valve assembly 32 and in the manner in which it controls the shape of the spray pattern emitted from the gun.

The fan pattern valve assembly 32 comprises the air flow control valve 102 which is cooperable with a valve seat 104 in the passageway 40 to determine the rate of air flow of the fan pattern shaping openings 88 in the air horns 90. Extending rearwardly from valve 102 within the passageway 40 is a valve shank or stem 106 which passes through a hollow valve casing 108. The shank terminates externally of the gun body and casing in an externally threaded end section 110. Two adjusting nuts or knobs 112, 114 are threaded onto the threaded end 110 of the shank. The innermost knob 112 is free for threaded rotational adjustment of the knob relative to the end 110 of the shank while the outermost or rearwardmost nut or knob 114 is fixed to the end of the shank by adhesive or by any conventional securement, as for example a tapered pin, a set screw, etc.

The casing 108 is provided with external threads 118 on its forwardmost end, which threads are threaded into a threaded section 120 of the air flow passageway 40. As explained more fully hereinafter, threads 118, 120 permit the casing 108 to be adjustably positioned within the passageway 40.

An axial bore 122 extends completely through the casing 108. At its rearward end the bore 122 terminates in a hexagonally shaped counterbore 124. This counterbore 124 receives a correspondingly shaped hexagonal flange 126 of the valve shank 106. The hexagonally shaped sections of the shank and casing bore function as a rotational driving connection between the shank 106 and the casing 108 so that rotation of the shank effects corresponding rotation of the casing 108. The hexagonally shaped counterbore 124 is axially longer than the hexagonally shaped shank located within the counterbore so as to permit axial movement of the shank with the casing while still retaining a rotational driving connection between the shank and casing.

The forward end of the bore 122 in the casing 108 is provided with an annular counterbore 130. Within this forwardmost counterbore there is located a seal 132, a spacer or stop 134, and a retaining ring 136. The retaining ring 136 functions to maintain and hold the seal and spacer or stop 134 within the counterbored end of the casing 108.

A compression spring 140 is located between the two nuts or knobs 112, 114. This spring 140 functions to retain the rotatably adjustable nut or knob 112 in an adjusted position relative to the other nut or knob 114 which is non-rotatably secured to the shank 106. Spring 140 functions to frictionally hold the nut 112 and casing 108 against inadvertent adjusting movement.

A second compression spring 142 is sandwiched between a washer 144 which bears against a boss 146 of the gun handle 11 and a washer 148 which bears against a retaining ring 149 mounted on the exterior of the casing. Spring 142 acts as a ground path providing earth ground to the entire assembly.

Figure 3:
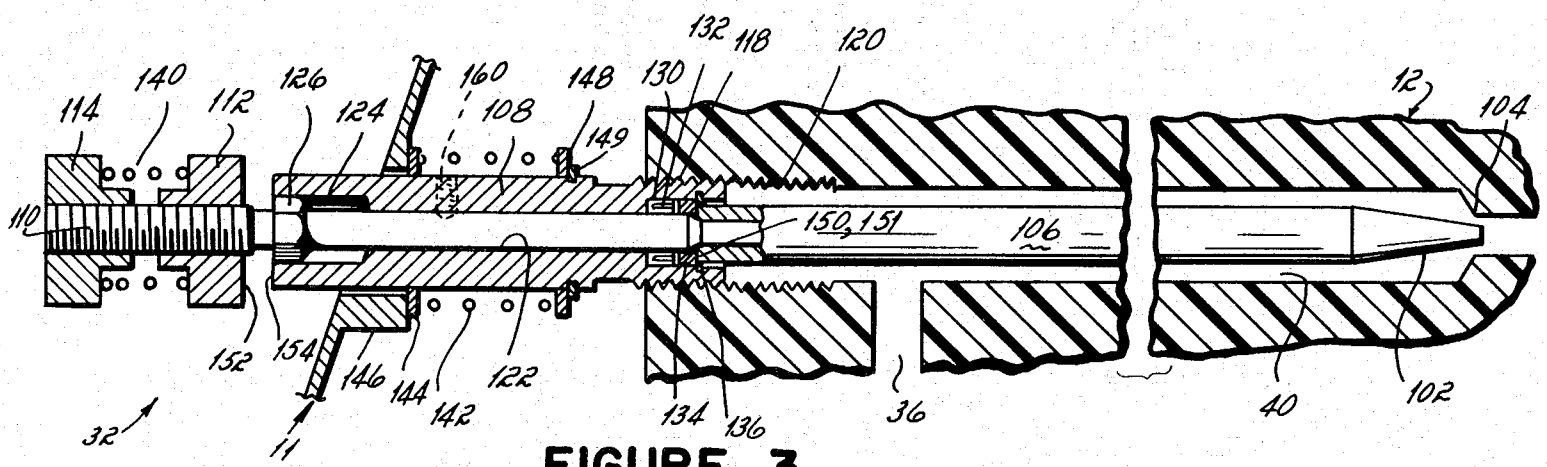
FIG. 3 is an enlarged cross-sectional view of the fan pattern control valve assembly of the gun of FIG. 1, illustrating the valve assembly in the wide pattern, high air flow position of the valve.

In operation of the fan pattern control valve assembly 32, air is provided via passageway 36 to air passageway 40. Air pressure within this passageway 40 passes over the valve 102 through the valve seat 104 to the fan pattern air openings 88 in the horns 90 of the nozzle. Assuming the fan pattern control valve 104 is in its rearwardmost position, illustrated in FIG. 3, a shoulder 150 of the valve shank 106 rests against a shoulder 151 of the spacer or stop 134 located internally of the casing 108. This establishes the high air flow position of the valve 102. The fan pattern valve 102 is movable forwardly from this high air flow position to the low air flow (narrow pattern) by application of forward axial manual or thumb pressure against the rear of the adjusting nut 114. Only so much force is required as to overcome frictional force applied to the shank 106 by a nylon set screw 160 threaded into the casing 108 and bearing against the shank 106. This force acting upon the rear adjusting nut 114 causes the shank of the valve to move forwardly until the forwardmost shoulder 152 of the adjusting nut 112 engages the rear shoulder 154 of the casing 108. This engagement of these two stop surfaces 152, 154 establishes the forwardmost position of the valve 102. In this forwardmost position, a restricted or low flow of air over the valve seat 104 results in a narrower spray pattern emitted from the gun.

Nylon set screw 160 bears against shank 106 with sufficient force so as to prevent pressure within passage 40 acting on valve 102 from forcing valve 102 rearwardly.

Both the high and low air flow positions of the valve are adjustable. For high air flow adjustment (wide fan pattern), the nut 114 is pulled rearwardly until the shoulder 150 on the shank 106 engages the forwardmost facing shoulder 151 of the spacer or stop 134. The adjusting knob or nut 114 is then rotated clockwise to decrease the air flow via the valve 102, or counterclockwise to increase the flow. Rotation of the knob 114 results in rotation of the attached valve shank 106, and through the driving connector 124, 126 rotation of this casing 108. This results in rotation of the casing 108 relative to the passage 40 in barrel 12 and consequent axial movement of the casing 108 relative to the barrel 12 as the casing 108 is threaded into or out of the threaded end 120 of the passage 40. This axial displacement of the casing 108 relative to the passage 40 in barrel 12 results in axial displacement of the stop 151 relative to the valve seat 104, thereby establishing the gap between the valve 102 and valve seat 104 in the high air flow setting of the fan pattern control valve assembly.

To adjust the low air flow setting, the adjusting knob 114 is pushed inwardly until shoulder 152 of the knob 112 engages the shoulder 154 of the casing 108. The knob 112 is then rotated clockwise to decrease the low flow setting or counterclockwise to increase the air flow in the low flow setting. The knob 114 must be pushed inwardly and maintained in its inward position while the knob is rotated and threaded over the threaded section 110 of the valve shank 106 to effect adjustment of the low air flow setting. As the knob 112 is rotated, it moves axially over the threaded end 110 of the shank 106 to reposition the stop surface shoulder 152 of the knob 112 relative to the shoulder 154 of the casing 108.

Figure 4:
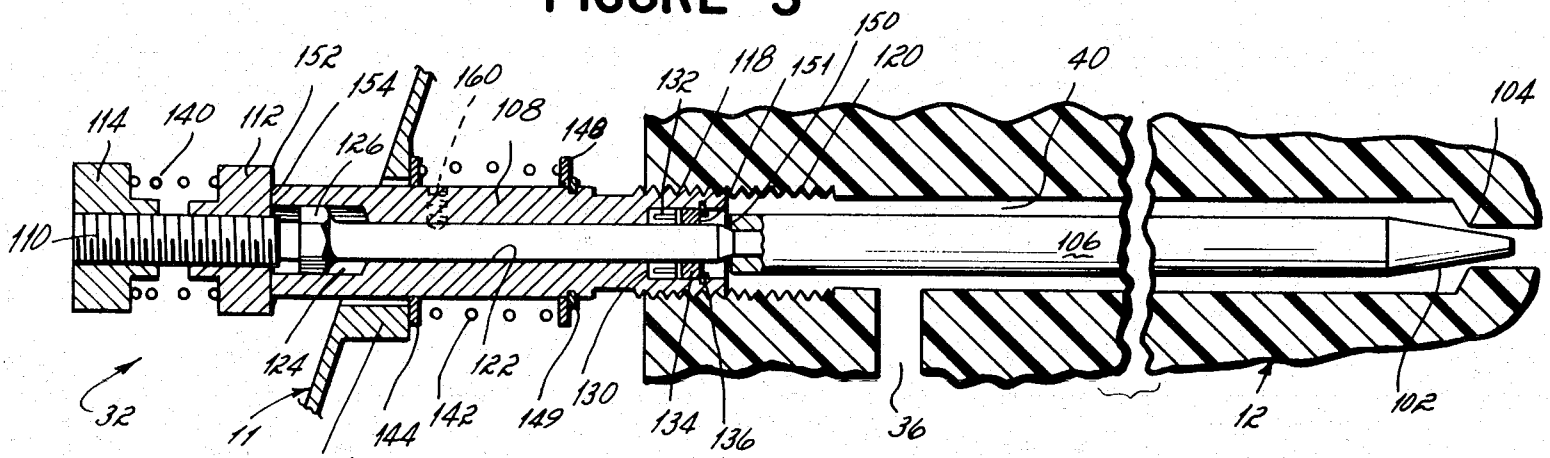
FIG. 4 is a view similar to FIG. 3 but illustrating the valve assembly in the narrow pattern, low air flow position of the valve.

In operation of the gun 10, pulling the trigger of the gun 26 rearwardly results in high pressure liquid flowing through the gun and out of the gun discharge orifice 72. Air is simultaneously directed via the passageway 36 to the fan pattern control passageway 40. Assuming the valve 102 is in its rearwardmost position, high flow of air will be provided via the fan pattern control valve 32 to the fan shaping openings 88 in the air horns 90, whereby the gun will spray a wide fan pattern. To change from a wide spray pattern to a narrow one, thumb pressure is applied to the rear of the adjusting nut 114 so as to force the nut and the attached valve shank 106 forwardly to the position illustrated in FIG. 4 wherein the forwardly facing shoulder 152 of the adjustment nut 112 rests against the rear surface 154 of the casing 108. Frictional force of the nylon set screw 160 acting upon the shank 106 will retain the fan pattern control valve assembly in this position until the adjusting nut 114 is manually pulled rearwardly to effect a change from a narrow to a wide spray pattern. Pulling the adjustment nut 114 rearwardly results in rearward opening movement of the valve 102 relative to the seat 104 until the shoulder 150 of the valve shank 106 engages the forwardly facing shoulder 151 of the stop 134 to establish the high air flow position of the valve. The valve will be retained in the high air flow (wide fan pattern) position by frictional force of the set screw 160 bearing against the shank 106 until that frictional force is overcome by manual force acting upon the adjustment screw 114.

While we have described only a single preferred embodiment of our invention, persons skilled in this art will appreciate numerous changes and modifications which may be made without departing from the scope of our invention. Therefore, we do not intend to be limited except by the scope of the following appended claims:

We claim:

1. A spray gun having a quick change pattern control valve assembly mounted thereon for varying the patterns of liquid emitted from said gun, said gun including a gun body, an air passage in said gun body, said pattern control valve assembly comprising a valve seat within the forward end of said passage, a valve mounted for axial movement toward and away from said seat, a tubular hollow casing, said casing having exterior threads threadedly engaged with interior threads located adjacent the rearward end of said passage, a shank integral with said valve and extending rearwardly through said hollow casing, a rotational driving connection between said shank and said casing, said connection permitting relative axial sliding motion between said shank and said casing, a threaded end on said shank projecting rearwardly of said casing, a first adjusting means fixedly secured onto the rearward end of said shank and a second adjusting means threadedly secured over the threaded end of said shank, an annular shoulder means on said shank facing rearwardly away from said valve seat, a first annular forwardly facing shoulder means on said casing engageable with said annular shoulder means on said shank, a second rearwardly facing shoulder means on said casing, forwardly facing shoulder means on said second adjusting means engageable with said second shoulder means on said casing, said pattern control valve assembly being movable between a first low air flow position upon application of forwardly directed manual pressure on the rear of said first adjusting means and a second high air flow position upon application of rearwardly directed manual pressure to said first adjusting means, said forwardly directed manual pressure being operable to move said valve forwardly toward said valve seat until said forwardly facing shoulder of said second adjusting means engages said second rearwardly facing shoulder means on said casing to establish the first forwardmost adjusted position of said valve relative to said valve seat and said rearwardly directed manual pressure on said first adjusting means being operable to move said valve rearwardly away from said valve seat until said rearwardly facing shoulder means on said shank engages said first forwardly facing shoulder means on said casing to establish the second rearwardmost adjusted position of said valve to said valve seat.

2. The spray gun of claim 1 wherein said second adjusting means is a nut threaded over the threaded end of said shank.

3. The spray gun of claim 1 wherein said first adjusting means is a knurled nut fixed onto the end of said shank.

4. The spray gun of claim 1 which further comprises a spring means operable between said gun body and said casing to frictionally restrain said casing against inadvertent adjusting movement relative to said air passage.

5. The spray gun of claim 1 which further comprises a spring means operable between said first and second adjusting means to frictionally restrain said second adjusting means against inadvertent movement relative to said valve shank.

6. A spray gun having a quick change pattern control valve assembly mounted thereon for varying the patterns of liquid emitted from said gun, said gun including a gun body, an air passage in said gun body, said pattern control valve assembly comprising a valve seat within the forward end of said passage, a valve mounted for axial movement toward and away from said seat, a tubular hollow casing, said casing having threads threadedly engaged with mating threads of said gun body, a shank integral with said valve and extending rearwardly through said hollow casing, a rotational driving connection between said shank and said casing, said connection permitting relative axial sliding motion between said shank and said casing, a threaded end on said shank projecting rearwardly of said casing, a first adjusting means fixedly secured onto the rearward end of said shank and a second adjusting means threadedly secured over the threaded end of said shank, an annular shoulder means on said shank facing rearwardly away from said valve seat, a first annular forwardly facing shoulder means on said casing engageable with said annular shoulder means on said shank, a second rearwardly facing shoulder means on said casing, forwardly facing shoulder means on said second adjusting means engageable with said second shoulder means on said casing, said pattern control valve assembly being movable between a first low air flow position and a second high air flow position, said control valve assembly being moved to said first low air flow position upon application of forwardly directed manual pressure on the rear of said first adjusting means, said forwardly directed manual pressure being operable to move said valve forwardly toward said valve seat until said forwardly facing shoulder of said second adjusting means engages said second rearwardly facing shoulder means on said casing to establish the first forwardmost adjusted position of said valve relative to said valve seat.

7. The spray gun of claim 6 wherein said second high air flow position of said pattern control valve assembly is established by said valve being moved rearwardly away from said valve seat until said rearwardly facing shoulder means on said shank engages said first forwardly facing shoulder means on said casing.

8. The spray gun of claim 6 wherein said second adjusting means is a nut threaded over the threaded end of said shank.

9. The spray gun of claim 6 wherein said first adjusting means is a knurled nut fixed onto the end of said shank.

10. The spray gun of claim 6 which further comprises a spring means operable between said gun body and said casing to frictionally restrain said casing against inadvertent adjusting movement relative to said air passage.

11. The spray gun of claim 6 which further comprises a spring means operable between said first and second adjusting means to frictionally restrain said second adjusting means against inadvertent adjusting movement relative to said valve shank.

12. A spray gun having a quick change pattern control valve assembly mounted thereon for varying the patterns of liquid emitted from said gun, said gun including a gun body, an air passage in said gun body, said pattern control valve assembly comprising a valve seat within the forward end of said passage, a valve mounted for axial movement toward and away from said seat, a tubular hollow casing, said casing having threads threadedly engaged with mating threads of said gun body, a shank integral with said valve and extending rearwardly through said hollow casing, a rotational driving connection between said shank and said casing, said connection permitting relative axial sliding motion between said shank and said casing, a threaded end on said shank projecting rearwardly of said casing, a first adjusting means fixedly secured onto the rearward end of said shank and a second adjusting means threadly secured over the threaded end of said shank, an annular shoulder means on said shank facing rearwardly away from said valve seat, a first annular forwardly facing shoulder means on said casing engageable with said annular shoulder means on said shank, a second rearwardly facing shoulder means on said casing, forwardly facing shoulder means on said second adjusting means engageable with said second shoulder means on said casing, said pattern control valve assembly being movable between a first low air flow position upon application of forwardly directed manual pressure on the rear of said first adjusting means and a second high air flow position, said forwardly directed manual pressure being operable to move said valve forwardly toward said valve seat until said forwardly facing shoulder of said second adjusting means engages said second rearwardly facing shoulder means on said casing to establish the first forwardmost adjusted position of said valve relative to said valve seat, and said second high air flow position being established by said rearwardly facing shoulder means on said shank being engaged with said first forwardly facing shoulder means on said casing to establish the second rearwardmost adjusted position of said valve relative to said valve seat.

13. The spray gun of claim 12 wherein said second adjusting means is a nut threaded over the threaded end of said shank.

14. The spray gun of claim 12 wherein said first adjusting means is a knurled nut fixed onto the end of said shank.

15. The spray gun of claim 12 which further comprises a spring means operable between said gun body and said casing to frictionally restrain said casing against inadvertent adjusting movement relative to said air passage.

16. The spray gun of claim 12 which further comprises a spring means operable between said first and second adjusting means to frictionally restrain said second adjusting means against inadvertent adjusting movement relative to said valve shank.

17. A spray gun having a quick change pattern control valve assembly mounted thereon for varying the patterns of liquid emitted from said gun, said gun including a gun body, an air passage in said gun body, said pattern control valve assembly comprising a valve seat within the forward end of said passage, a valve mounted for axial movement toward and away from said seat, a tubular hollow casing, said casing having threads threadedly engaged with mating threads of said gun body, a shank integral with said valve and extending rearwardly through said hollow casing, a rotational driving connection between said shank and said casing, said connection permitting relative axial sliding motion between said shank and said casing, a threaded end on said shank projecting rearwardly of said casing, a first adjusting means fixedly secured onto the rearward end of said shank and a second adjusting means threadedly secured over the threaded end of said shank, an annular shoulder means on said shank facing rearwardly away from said valve seat, a first annular forwardly facing shoulder means on said casing engageable with said annular shoulder means on said shank, a second rearwardly facing shoulder means on said casing, forwardly facing shoulder means on said second adjusting means engageable with said second shoulder means on said casing, said pattern control valve assembly being movable between a first low air flow position and a second high air flow position, said first low air flow position being established by being operable to move said valve forwardly toward said valve seat, said forwardly facing shoulder of said second adjusting means engaging said second rearwardly facing shoulder means on said casing to establish the first forwardmost adjusted position of said valve relative to said valve seat, and said second high air flow position being established by said rearwardly facing shoulder means on said shank being engaged with said first forwardly facing shoulder means on said casing to establish the second rearwardmost adjusted position of said valve relative to said valve seat.

* * * * *